US005411159A

United States Patent [19]

Fan

[11] Patent Number: 5,411,159

[45] Date of Patent: May 2, 1995

[54] EASILY OPENABLE CAN WITH FOLDABLY CONCEALED TAB

[76] Inventor: Kuo-Wei Fan, No. 302, Chung-san Road, Sec. 2, Hu-Kuo Hsiang, Hsin Chu Hsien, Taiwan, Prov. of China

[21] Appl. No.: 227,624

[22] Filed: Apr. 14, 1994

[30] Foreign Application Priority Data

Apr. 29, 1993 [CN] China ..... 93105201.7

[51] Int. Cl.[6] ..... B65D 17/34

[52] U.S. Cl. ..... 220/269; 220/265

[58] Field of Search ..... 220/265, 268, 269

[56] References Cited

U.S. PATENT DOCUMENTS

| | | | |
|---|---|---|---|
| 3,442,416 | 5/1969 | Nicholson | 220/269 |
| 3,717,279 | 2/1973 | Patarini et al. | 220/269 |
| 3,734,338 | 5/1973 | Schubert | 220/269 |
| 3,757,989 | 9/1973 | Brown | 220/269 |
| 3,908,856 | 9/1975 | Perry | 220/269 |
| 4,231,487 | 11/1980 | Hasegawa | 220/269 |
| 4,399,925 | 8/1983 | Fundom | 220/269 |
| 4,417,668 | 11/1983 | Stolle | 220/269 |
| 4,503,989 | 3/1985 | Brown et al. | 220/269 |
| 4,576,305 | 3/1986 | Saunders | 220/269 |
| 4,801,038 | 1/1989 | Grigorenko | 220/269 |

*Primary Examiner*—Allan N. Shoap
*Assistant Examiner*—Vanessa Caretto

[57] ABSTRACT

An easily openable can includes a foldable tab having an actuating ring attached on the tab and normally flatly sealing a drinking opening formed on a can cover and operatively openable along a score line along a contour of the tab on the cover, a base folding line concave downwardly and pre-formed in a rear base portion of the tab, and an intermediate folding line convex upwardly and preformed on an intermediate portion of the tab, whereby upon pulling of the actuating ring and the tab to open the drinking opening and then upon folding of the tab along the base folding line and the intermediate folding line, the tab can be folded and retained on a rear opening edge without dropping into a can interior for hygienic purpose and also to allow the actuating ring to conceal a sharp edge of the tab severed from the can cover for safety reason.

1 Claim, 3 Drawing Sheets

EASILY OPENABLE CAN WITH FOLDABLY CONCEALED TAB

BACKGROUND OF THE INVENTION

A conventional beverage can as shown in FIG. 7 includes an end over C having a tab T secured with a pulling ring P and normally sealing a drinking opening O formed on the cover C, whereby upon pulling of the ring P and the tab T to disclose the opening O for drinking purpose, the tab T, if not being suitably disposed, will cause environmental protection problem.

Even though another conventional can as shown in FIG. 8 may prevent a free disposal of the tab T for the reason of environmental protection, the tab T once biased downwardly inwardly into an interior of the can by pulling the pulling ring P to disclose the drinking opening O may decant dust particles D previously accumulated on the cover and tab surface into the can beverage, causing contamination and hygienic problems to the beverage or materials stored in the can and possibly influencing the user's health.

SUMMARY OF THE INVENTION

Therefore, an object of the present invention is to provide an easily openable can including a foldable tab having an actuating ring attached on the tab and normally flatly sealing a drinking opening formed on a can cover and operatively openable along a score line along a contour of the tab on the cover, a base folding line concave downwardly and pre-formed in a rear base portion of the tab, and an intermediate folding line convex upwardly and preformed on an intermediate portion of the tab, whereby upon pulling of the actuating ring and the tab to open the drinking opening and then upon folding of the tab along the base folding line and the intermediate folding line, the tab can be folded and retained on a rear opening edge without dropping into a can interior for hygienic purpose and also to allow the actuating ring to conceal a sharp edge of the tab severed from the can cover for safety reason.

DETAILED DESCRIPTION

Figure 1:
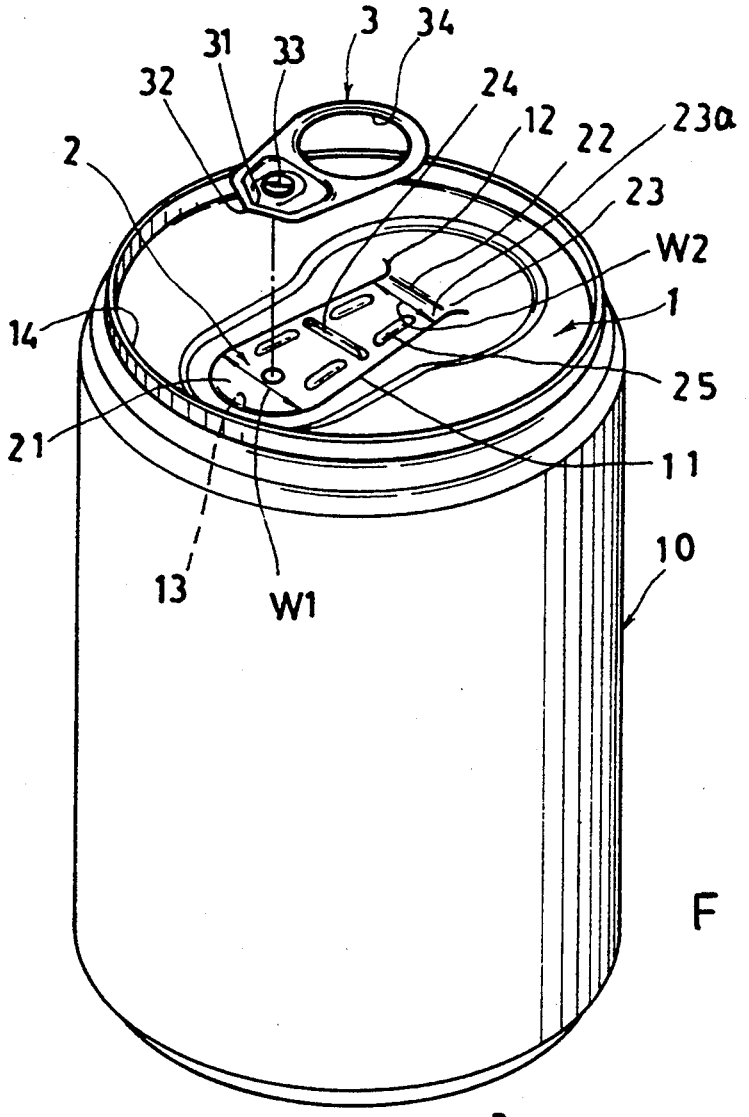
FIG. 1 is a perspective view of the present invention.
Figure 2:
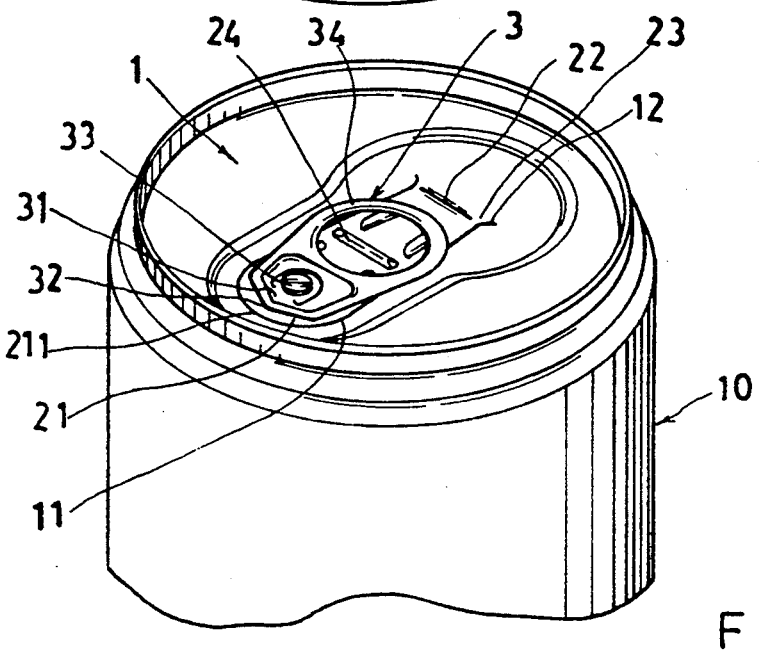
FIG. 2 is an illustration of the present invention when riveting an actuating ring on a foldable tab.

As shown in FIGS. 1–6, the present invention comprises: a can 10 having a can cover 1 capping a top end portion of the can 10, a foldable tab 2 normally flatly shielding a drinking opening 13 formed in the can cover 1, a score line 11 preformed on the can cover 1 and confining a circumferential edge portion of the tab 2, and an actuating ring 3 secured to the foldable tab 2.

The foldable tab 2 is generally formed as an elongate tongue shape and includes: a front tab portion 21 secured with the actuating ring 3 by a rivet 33 adjacent to a rim flange 14 circumferentially disposed around the can cover 1, a base folding line 22 transversely notched on a base portion 23 of the tab 2 with the base portion 23 formed on a rear end of the tab 2 adjacent to a central portion of the can cover 1 with the base folding line 22 having a longitudinal section of the tab 2 at the base folding line 22 concave upwardly when the tab 2 normally flatly shields the drinking opening 13 of the can cover 1, and an intermediate folding line 24 transversely formed on an intermediate portion of the tab 2 and having a longitudinal section of the tab 2 at the intermediate folding line 24 convex upwardly when the tab 2 normally flatly shields the drinking opening 13 of the can cover 1.

The actuating ring 3 includes: a front plate portion 31 secured to the front tab portion 21 by a rivet 33, an acute end portion 32 formed on a central front portion of the front plate portion 31 and bent downwardly from the front plate portion 31 towards an outermost end 211 of the front tab portion 21, and a ring member 34 protruding rearwardly from the front plate portion 31 for pulling or pushing the ring member 34.

The foldable tab 2 includes the front tab portion 21 having a first width W1 matching with a front opening width 131 of the drinking opening 13 formed on a front opening edge of the drinking opening 13 when opened by tearing the foldable tab 2, and having a second width W2 of a rear tab portion **23*a* adjacent to the base portion 23 of the tab 2 with the second width W2 matching with a rear opening width 132 of the drinking opening 13 formed on a rear opening edge of the drinking opening 13 when opened by tearing the foldable tab 2, with the first width W1 at the front tab portion 21 larger than the second width W2 at the rear tab portion 23*a*, whereby upon tearing of the tab 2 to open the drinking opening 13 and folding and depressing the tab 2 downwardly, the front tab portion 21 of the tab 2 can be stably locked on the rear opening edge of the drinking opening 13 by downwardly squeezing the front tab portion 21 with wide width W1 to be engaged with and retained on the rear opening edge with narrow rear opening width 132. The folded and locked tab 2 will not be further "sinked" downwardly into the interior of the can 10 to prevent injury to a user's fingers and also to prevent contamination of the beverage stored in the can 10**.

The foldable tab 2 includes two curved line ends 12 diverging rearwardly sidewardly from two end portions of a score line 11 preformed on the can cover 1 to reduce a stress or an inertia force whenever tearing the tab 2 for opening the drinking opening 13, thereby preventing continuously cutting and separation of the tab 2 off the can cover 1 for environmental protection.

The foldable tab 2 includes a plurality of reinforcing ribs 25 each reinforcing rib 25 longitudinally formed on the tab 2 for strengthening the tab 2 and for preventing a bending deformation of the tab 2 when folded to be retained on an opening edge of the drinking opening 13 of the can cover 1.

The actuating ring 3 includes the ring member 34 having a ring area along an outer circumferential edge slightly larger than a tab area defined between a front tab portion 21 and an intermediate folding line 24 (FIG. 6) when the tab 2 is folded and depressibly retained on a rear opening edge of the drinking opening 13 on the cover 1.

Figure 3:
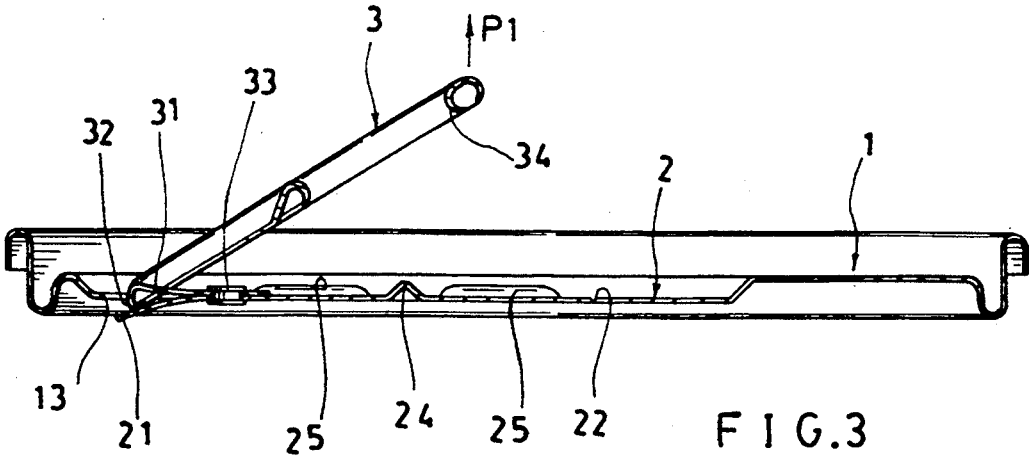
FIG. 3 shows a first step for disclosing a drinking opening of the present invention.
Figure 4:
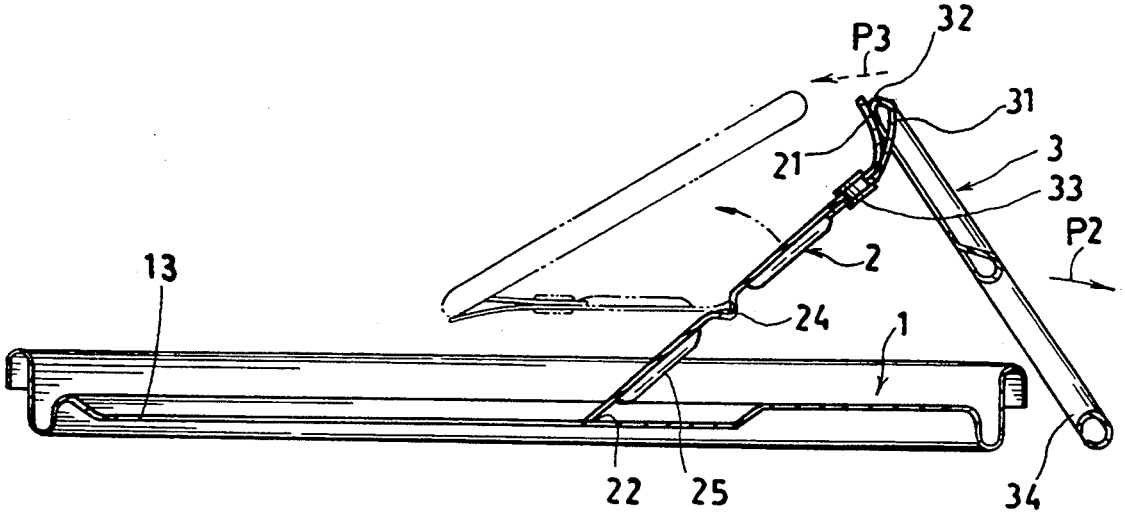
FIG. 4 shows a second step following FIG. 3 when the opening is fully opened.
Figure 5:
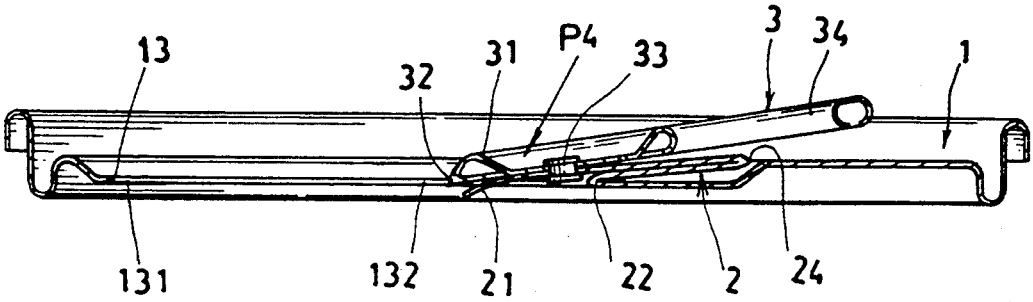
FIG. 5 shows a final step when folding the tab to be retained on a rear edge of the opening in accordance with the present invention.
Figure 6:
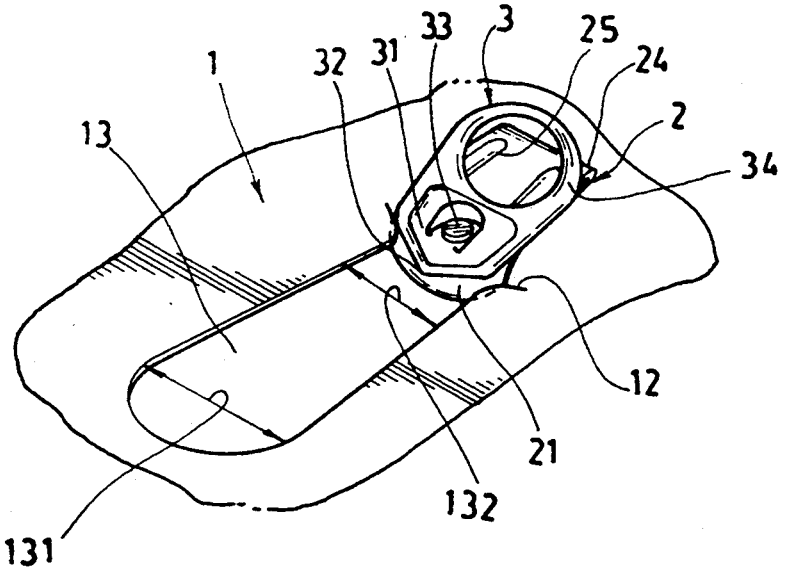
FIG. 6 is an illustration showing a folded tab of the present invention.
Figure 7:
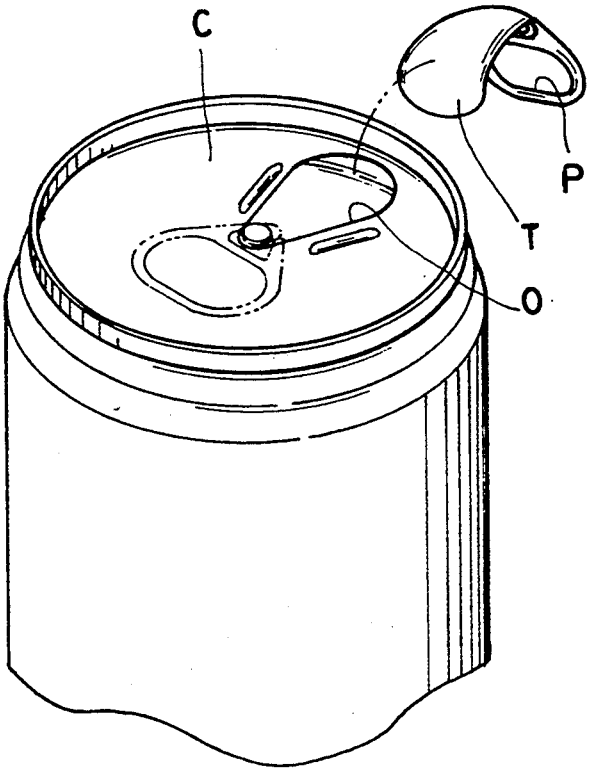
FIG.7 PRIOR ART
FIG. 7 shows a first conventional easily openable beverage Call.
Figure 8:
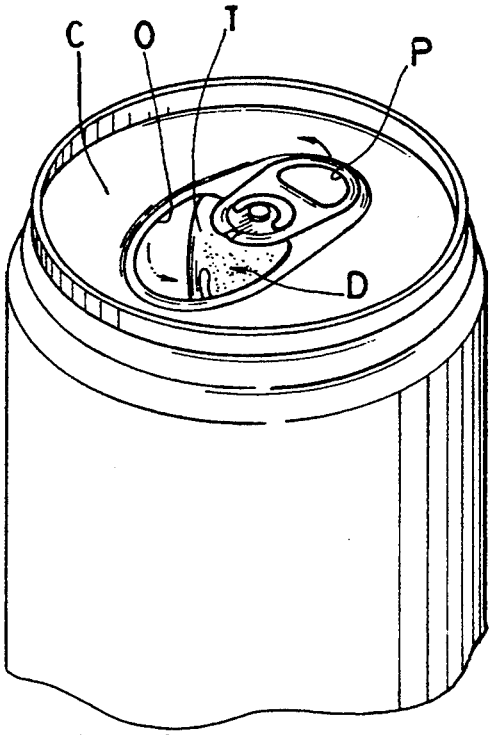
FIG.8 PRIOR ART
FIG. 8 shows a second conventional beverage can.

When it is intended to disclose the opening 13 for drinking beverage stored in the can 10, several operation steps can be done such as shown in FIGS. 3–5, in which:

a. The actuating ring 3 is pulled upwardly (P1) to bias the front acute end portion 32 of the actuating ring 3 downwardly about a fulcrum at the rivet 33 to forcibly depress the front tab portion 21 downwardly to initiate the disclosing of the opening 13 along the score line 11 formed on the can cover 1;

b. The ring 3 is continuously pulled rearwardly (P2) about the base folding line 22 to fully open the opening 13; and then the ring 33 is pushed forwardly (P3) to further fold the tab 2 about the intermediate folding line 24 as shown in dotted line of FIG. 4 (the folding line 24 now becoming concave downwardly for an easier folding thereabout) to form a generally Z-shaped "folding structure" as shown in dotted line of FIG. 4; and c. The ring member 34 is depressed downwardly (P4) to squeeze the front tab portion 21 downwardly to be locked on a rear opening edge of the drinking opening 13 of the can cover 1. The tab 2 is now folded and flattened to minimize its volume. Since the ring member 34 may have a ring area along an outer circumferential edge of the ring member 34 slightly larger than a tab area defined between the front tab portion 21 and the intermediate folding line 24 as shown in FIG. 6, a sharp edge of the tab 2 as severed from the can cover 1 will be shielded by the ring member 34 of the actuating ring 3, thereby preventing an injury such as being cut by the severed edge of the torn tab 2.

The present invention is superior to any conventional easily openable can with the following advantages:

1. The tab 2 even having dust accumulated thereon is folded above and retained on the can cover 1 to prevent a downwardly deep "sinking" of a conventional tab removed from the can into a can interior, thereby preventing contamination to the beverage stored in the can.
2. Severed cutting edge of a torn tab is shielded by (or concealed under) the ring member 34 of the actuating ring 3 to prevent injury to the user for safety purpose.
3. The tab is multiply folded to be stably retained on the can cover to prevent a removal of the tab from the can in order for a better environmental protection.
4. Since the tab 2 should have a longer distance for providing the multiple folding lines 22, 24 thereon, it can therefore be printed or marked with more words or features for advertising or promotional purposes in comparison with the conventional can tab having shorter length (or less area) than that of this application. So, this application can afford a better commercial value in addition to its safety and hygienic advantages as aforementioned.

I claim:

1. An easily openable can comprising:

a can cover (1) capping a top end portion of a can having a score line (11) preformed on the can cover circumferentially confining a foldable tab (2) which normally flatly shields a drinking opening (13) formed in the can cover (1) having a circumferential opening edge of the drinking opening (13) matching with the score line (11) on said can cover (1);

said foldable tab (2) generally formed as an elongate tongue shape and including: a front tab portion (21) secured with an actuating ring (3) by a rivet (33) adjacent to a rim flange (14) circumferentially disposed around the can cover (1), said score line having terminal end portions located on either side of the tab forming a rear end of the tab, said rear end located adjacent to a central portion of the can cover (1), a base folding line (22) transversely notched on a base portion (23) of the tab (2) with the base portion (23) formed on said rear end of the tab (2) with the base folding line (22) having a longitudinal section of said tab (2) at said base folding line (22) concave upwardly when the tab (2) normally flatly shields the drinking opening (13) of the can cover (1), and an intermediate folding line (24) transversely formed on an intermediate portion of the tab (2) and having a longitudinal section of said tab (2) at said intermediate folding line (24) convex upwardly when the tab (2) normally flatly shields the drinking opening (13) of the can cover (1); with the front tab portion (21) having a first width (W1) matching with a front opening width (131) of the drinking opening (13) formed on a front opening edge of the drink opening (13) when opened by tearing the foldable tab (2), and having a second width (W2) of a rear tab portion (**23*a*) adjacent to the base portion (23) of the tab (2) with the second width (W2) matching with a rear opening width (132) of the drinking opening (13) formed on a rear opening edge of the drinking opening (13) when opened by tearing tab the foldable tab (2), with the first width (W1) at the front tab portion (21) larger than the second width (W2) at the rear tab portion (23*a*), said front tab portion (21) engageable with said rear opening edge of the drinking opening (13), whereby upon tearing of the tab (2) to open the drinking opening (13) and folding and depressing the tab (2) downwardly, the front tab portion (21) of the tab (2) can be stably locked on the rear opening edge of the drinking opening (13) by downwardly squeezing the front tab portion (21) with wide width (W1) to be engaged with and retained on the rear opening edge with narrow rear opening width (132); and said actuating ring (3) including: a front plate portion (31) secured to the front tab portion (21) by the rivet (33), an acute end portion (32) formed on a central front portion of the front plate portion (31) and adjacent to an outermost end (211) of the front tab portion (21), and a ring member (34) protruding rearwardly from the front plate portion (31**);

whereby upon pulling of said tab (2) for disclosing the drinking opening (13) and upon folding of the tab along said base and intermediate folding lines (22), (24), the tab (2) can be folded and retained on the opening of the can cover (1).

* * * * *